US008141571B2

(12) United States Patent
Granger

(10) Patent No.: US 8,141,571 B2
(45) Date of Patent: Mar. 27, 2012

(54) SUPPLEMENTAL MEDICAL GAS SYSTEM

(75) Inventor: Jacob Granger, Murrieta, CA (US)

(73) Assignee: Certified Medical Sales, Murrieta, CA (US)

( * ) Notice: Subject to any disclaimer, the term of this patent is extended or adjusted under 35 U.S.C. 154(b) by 355 days.

(21) Appl. No.: 12/471,112

(22) Filed: May 22, 2009

(65) Prior Publication Data

US 2010/0294372 A1 Nov. 25, 2010

(51) Int. Cl.
*B65H 75/40* (2006.01)
*F17C 7/00* (2006.01)

(52) U.S. Cl. ..... 137/1; 137/355.26

(58) Field of Classification Search ..... 137/240, 137/355.26, 355.21, 355.2, 355.16, 1
See application file for complete search history.

(56) References Cited

U.S. PATENT DOCUMENTS

| | | | | |
|---|---|---|---|---|
| 4,860,803 | A * | 8/1989 | Wells | 141/9 |
| 5,520,212 | A * | 5/1996 | Williams | 137/355.23 |
| 5,526,877 | A * | 6/1996 | Winz | 166/88.2 |
| 6,305,400 | B1 | 10/2001 | Simo et al. | |
| 6,648,008 | B1 * | 11/2003 | Price | 137/312 |
| 6,725,483 | B2 * | 4/2004 | Gallant et al. | 5/658 |
| 6,878,881 | B1 * | 4/2005 | Henry | 174/101 |

* cited by examiner

*Primary Examiner* — Kevin Lee
(74) *Attorney, Agent, or Firm* — Walter A. Hackler

(57) ABSTRACT

A supplemental medical gas system and method utilizes a wheeled handcart, a reel disposed thereon having a length of the hose disposed thereon and extendable therefrom. Couplings are provided and disposed on opposite end of the hose for establishing connection with a gas supply and a hospital conduit system. In addition, at least one berm disposable on the handcart and deployable therefrom is provided for overlaying the extended hose for enabling the vehicular travel thereacross.

4 Claims, 2 Drawing Sheets

SUPPLEMENTAL MEDICAL GAS SYSTEM

The present invention generally relates to the supply of medical gases necessary in medical facilities. More specifically, the present invention is directed with the reconnection of a primary supply of gas to the medical facility in the event the primary supply is disconnected from the medical facility.

A wide variety of gases are utilized in medical facilities such as medical air, oxygen, nitrogen, nitrous oxide, and carbon dioxide. Conduit systems are often installed in medical facilities and gas service may be provided through such conduits which provides the gas within the facility at various designated areas.

Typically, a bulk supply source of the gas is loaded exterior to the medical facility for maintenance by outside vendors providing various gases and interconnected by underground lines.

It may be necessary, under certain circumstances to temporarily connect the exterior gas supply source to the medical facility conduit system. Such instances might involve in emergency, any scheduled maintenance, or for testing.

In the case of an emergency, causing disruption of the connection between the primary supply and the medical facility, a reconnection, in short order, is of utmost importance for patient safety and the present invention fills that need.

SUMMARY OF THE INVENTION

A supplemental medical gas system in accordance with the present invention includes a wheeled handcart along with a reel disposed on the handcart with a length of hose disposed on the reel and extendable therefrom.

Couplings are provided and disposed on opposite sides of the hose with the fittings being suitable for connection with the gas supply and a low-pressure hospital medical gas conduit system. At least one berm, or drive over plate, disposable on the handcart and deployable therefrom, is provided for overlaying the extended hose for enabling vehicle traffic thereover.

The system may further include a valve for enabling purging of the extended hose and an oxygen monitor for determining the purity of gas in the hose during purging.

A method in accordance with the present invention for transferring medical gas from a remote stationary bulk supply of gas to a spaced apart hospital gas conduit system during interruption of a primary connection between the remote station supply and the conduit system generally includes providing a wheeled handcart with a rotatable reel for supporting a length of hose with the hose having coupling fittings on ends thereof.

The method further includes connecting one length of the hose to the gas supply via one of the couplings and thereafter unreeling the hose and extending the hose to the spaced apart hospital conduit system. Gas reconnection is made by connecting another end of the hose to the conduit system via another of the couplings.

In this method, the hose is purged with the gas prior to the transfer of gas from the supply to the conduit system.

In order to maintain integrity of the hose, the method further may include disposing of berms, or drive over plates, over the extended hose to enable vehicle traffic thereover.

Alternatively, the method and system in accordance with the present invention may be utilized between a bulk oxygen tank and location such as a Mass Casualty Site to provide gaseous oxygen as may be necessary.

BRIEF DESCRIPTION OF THE DRAWINGS

The advantages and features of the present invention will be better understood by the following description when considered in conjunction with the accompanying drawings in which.

DETAILED DESCRIPTION

Figure 1:
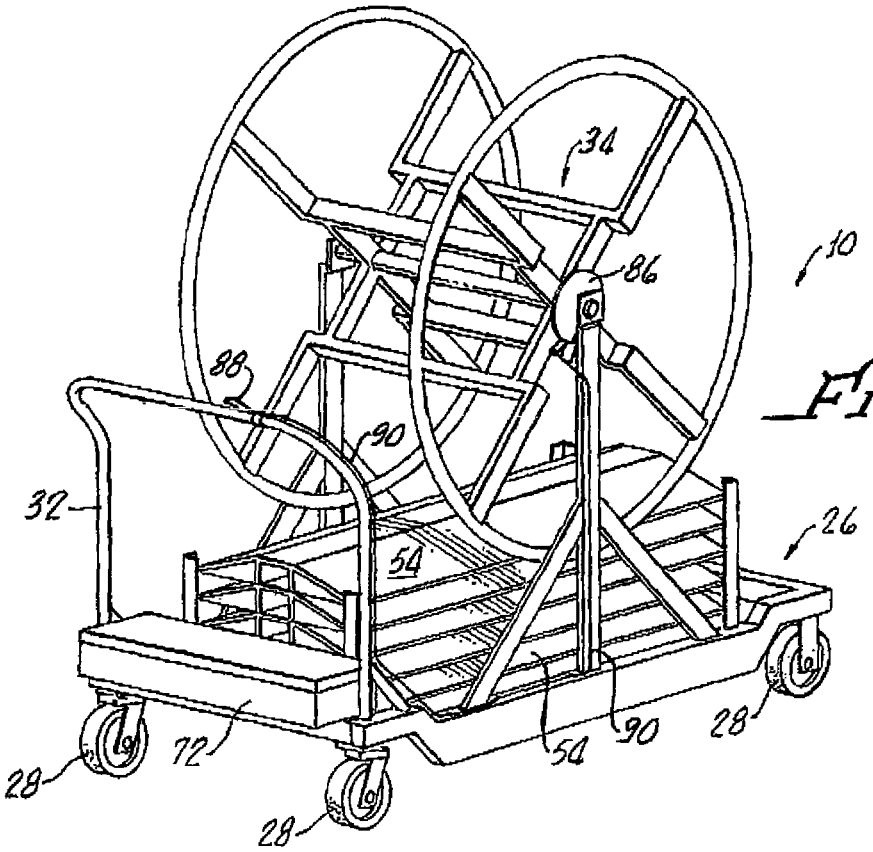
FIG. 1 is a perspective view of a system in accordance with the present invention generally illustrating a handcart with a reel thereon along with a plurality of berms and a toolbox.

With reference to FIGS. 1-5, there is shown a supplemental medical gas system 10 for transferring medical gas, for example, oxygen, from a remote stationary bulk supply 14 to a spaced apart hospital medical gas conduit system 18 disposed in a hospital-type facility 22. Deployment of the system is essential during interruption of a permanent connection (not shown) between the remote supply 14 and the conduit system 18, such interruption being unexpected. Alternatively, the interruption may be one of planned maintenance or other reasons, such as inspection, when a temporary connection between the supply 14 and conduit 18 is necessary.

The system 10 generally includes a handcart 26 supported by wheels 28 to facilitate manual movement thereof via an upstanding handlebar 32.

Figure 2:
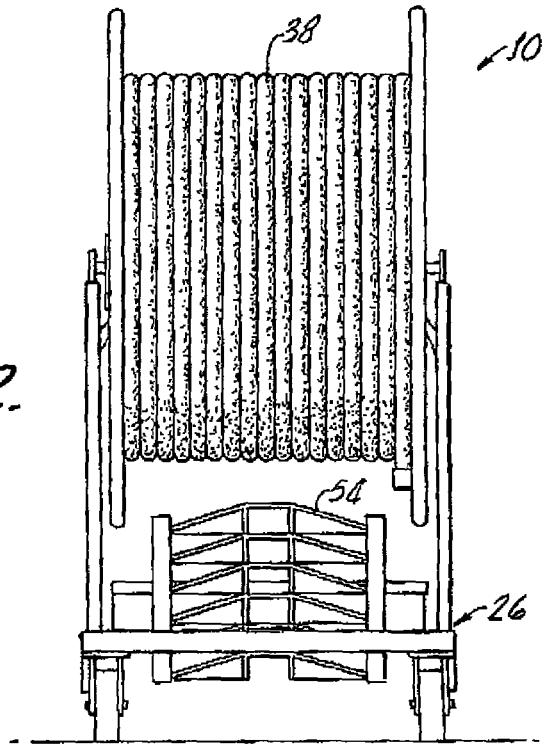
FIG. 2 is an elevation view of the system as shown in FIG. 1 illustrating the reel with a hose wound thereabout.
Figure 3:
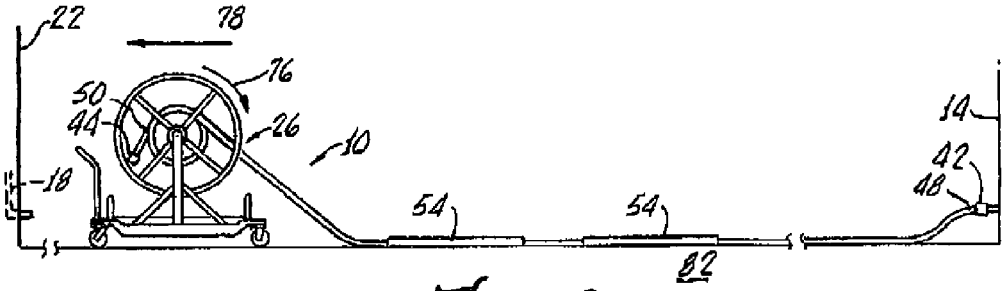
FIG. 3 is a diagram showing deployment of the system in accordance with the present invention for interconnecting a remote stationary supply of gas to a spaced apart medical conduit system by deployment of the hose.
Figure 4:
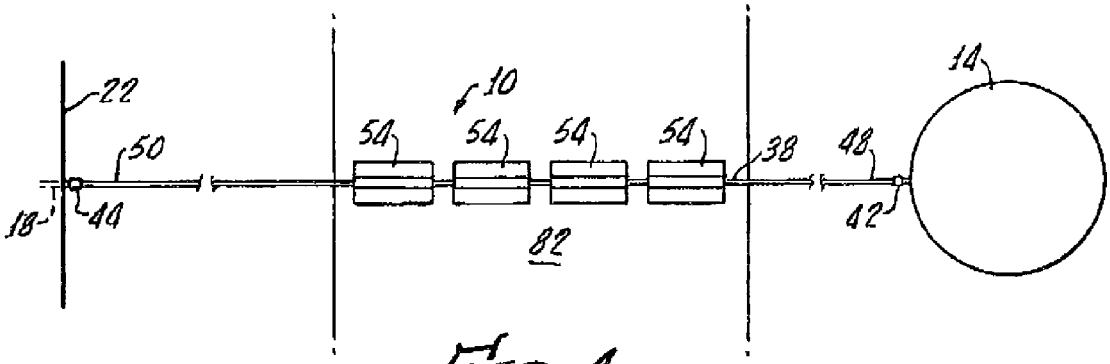
FIG. 4 is a plan view of the deployed hose along with a plurality of berms, or drive over plates, disposed thereover enabling vehicular traffic.

The handcart 26 further supports a rotatable reel 34 which supports a hose 38 thereon in a conventional manner as shown in FIG. 2. The hose 38 has a preselected length to extend from the supply 14 to the conduit 18. Coupling fittings 42, 44, disposed on opposite hose ends 48, 50 are provided for connection to the supply 14 and conduit system 18 respectively. Berms 54 are provided for overlaying the extended hose, as illustrated in FIGS. 3 and 4 for enabling safe vehicle traffic over the hoses. The Berms 54 are conveniently stored on the handcart 26, when not deployed, as shown in FIG. 1.

Figure 5:
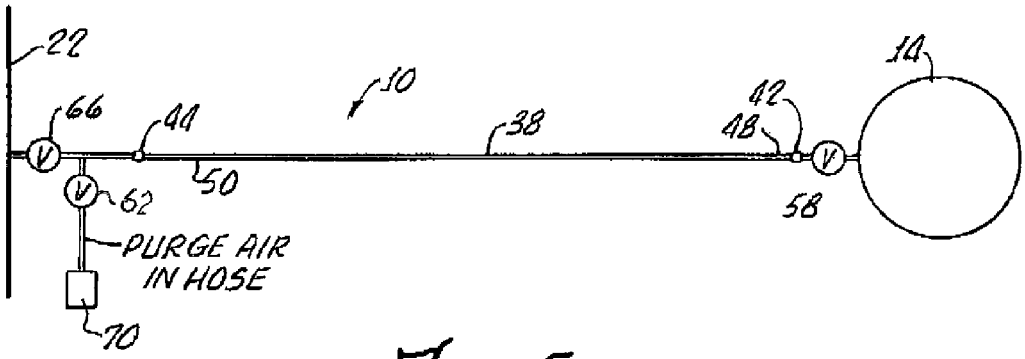
FIG. 5 illustrates valving arrangement for enabling purging of the hose with gas before communication is established with the conduit system of the medical facility.

As schematically shown in FIG. 5, the fitting 42 is attach proximate an on/off valve 58 which is part of the supply 14 and a second on/off valve 62 is provided and disposed proximate an on/off valve 66 to the conduit 18. The valve 62 enables a purging of the hose 38 with gas from the supply 14 in a conventional manner so that no contamination is introduced into the conduit 18 of the facility 22.

In that regard, a gas analyzer 70 may be provided for the determining purity in the gas in the hose 38 during purging.

Because the handcart 26 with stored hose 38 and berms 54 are conveniently and compactly stored near the facility, its deployment in a rapid manner during emergencies is facilitated. Also in that regard, wrenches and the like, not shown, for attaching and removing the fittings 42, 44 may also be conveniently stored in a toolbox 72 also carried by the handcart 26.

Thus, a method in accordance with the present invention for transferring gas from a remote supply 14 to a spaced apart hospital medical conduit system 18 during interruption of a permanent connection (not shown) between the remote supply 14 and the conduit system 18 includes providing the wheeled handcart 26 with a rotatable reel 24 for supporting a length of hose 38 with the hose having coupling fittings 42, 44 on ends 48, 50 thereof.

The method further includes connecting one end 48 of the hose 38 to the gas supply 14 via one of the couplings 42 and thereafter unreeling of the hose 38 as illustrated by the arrow 76 in FIG. 3 as the handcart is moved toward the facility 22 as indicated by the arrow 78 for deploying the hose 38 across and area 82 as illustrated in FIGS. 3 and 4 thereafter the another end 50 of the hose 38 is connected to the facility 22 conduit system 18 via the coupling 44.

Before fluid communication is established between the hose 38 supply 14 and conduit 18, the hose 38 is purged of air with the gas from the supply 14.

In the event the area 82 is a roadway, the method further includes disposing berms 54 over the hose 38 as illustrated in FIGS. 3 and 4 to enable vehicular travel thereover without damaging the hose 38.

During unreeling of the hose 38, a disk brake 86, controlled by a grip 88 disposed on the handlebar 32 via cable 90, provides for constant hose 38 payout. This prevents any undesired hose 38 overdeployment.

Although there has been hereinabove described a supplemental medical gas system in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. A method for transferring medical gas from a remote stationary bulk supply of gas to a spaced apart low pressure hospital medical gas conduit system during interruption of a permanent connection between the remote stationary supply and the conduit system, the method comprising:

providing a wheeled cart with a rotatable reel for supporting a length of hose, said hose having a coupling fitting on each thereof;

connecting one end of the hose to the remote stationary bulk supply of gas via one of the coupling fittings the bulk supply of gas being separated from said wheeled cart;

unreeling the hose and extending the hose to the spaced apart conduit system; and connecting another end of the hose to the conduit system via another of the coupling fittings, the conduit system being separated from said wheeled cart.

2. The method according to claim 1 further comprising purging the hose with the gas prior to transfer of the gas from the supply to the conduit system.

3. The method according to claim 1 further comprising disposing berms over the extended hose to enable vehicle traffic thereover.

4. A method according to claim 3 further comprising controlling hose payout during hose unreeling via a reel brake.

* * * * *